US005564575A

United States Patent [19]

Casement

[11] Patent Number: 5,564,575

[45] Date of Patent: Oct. 15, 1996

[54] BALLOON SCULPTURING APPARATUS

[76] Inventor: Lane Casement, 10440 Wapiti Drive S.E., Calgary, Alberta, Canada, T2J 1J4

[21] Appl. No.: 295,551

[22] Filed: Aug. 25, 1994

[30] Foreign Application Priority Data

Sep. 22, 1993 [CA] Canada ..... 2106727

[51] Int. Cl.[6] ..... A47F 7/00

[52] U.S. Cl. ..... 211/13; 220/475; 220/476; 248/558; 446/220; 446/221

[58] Field of Search ..... 211/13, 14; 248/121, 248/544, 558, 205.3; 446/221, 220, 225; 206/315.9; 220/475, 476; 362/404

[56] References Cited

U.S. PATENT DOCUMENTS

| | | | |
|---|---|---|---|
| 670,144 | 3/1901 | Bond | 211/13 |
| 1,024,369 | 4/1912 | Sechrist | 362/404 |
| 1,145,588 | 7/1915 | Hofrichter | 362/404 |
| 1,487,609 | 3/1924 | Sammons | 211/13 |
| 2,220,220 | 11/1940 | Cusimano | 211/13 |
| 2,418,067 | 3/1947 | Carpenter, Sr. | 248/121 |
| 2,894,638 | 7/1959 | Northover | 211/13 |
| 3,315,819 | 4/1967 | Kingsbery | 211/13 |
| 4,953,713 | 9/1990 | Yaffe | 211/13 |
| 4,974,393 | 12/1990 | Rich et al. | 53/433 |
| 5,004,633 | 4/1991 | Lovik | 446/221 |

*Primary Examiner*—Ramon O. Ramirez
*Assistant Examiner*—Michael J. Turgeon
*Attorney, Agent, or Firm*—Anthony R. Lambert

[57] ABSTRACT

A balloon sculpturing apparatus is described which includes a support and a plurality of inverted receptacles with balloon receiving cavities disposed about the support. Balloons filled with lighter than air gas are retained by buoyancy in the balloon receiving cavities of the inverted receptacles. The balloon sculpturing apparatus produces a consistent bouquet in a time efficient manner.

10 Claims, 5 Drawing Sheets

BALLOON SCULPTURING APPARATUS

The present invention relates to a balloon sculpturing apparatus.

BACKGROUND OF THE INVENTION

When celebrating special occasions, balloons are commonly formed into decorative bouquets. When a plurality of decorative balloon bouquets are being prepared it is extremely difficult to get them uniform. This uniformity can relate to uniformity from bouquet to bouquet or uniformity between balloons within a bouquet. Balloon sculpturing apparatus are used to achieve a greater degree of uniformity in balloon bouquets, thereby enhancing the visual effect achieved.

U.S. Pat. No. 4,953,713 which was granted to Yaffe in 1990 and U.S. Pat. No. 5,036,985 which was granted to Lovik in 1991 serve as examples of balloon sculpturing apparatus. The Yaffe reference discloses a base with an upstanding support structure having a plurality of vertically spaced attachment points to which strings tethering balloons can be attached. The Lovik reference discloses a base with an upstanding support structure having a plurality of vertically spaced sculpturing rings. Each of the sculpturing rings having a plurality of slots which are adapted to receive a neck of a balloon.

The Lovik reference is not suited for preparing the most common form of decorative balloon arrangement, that being a balloon cluster tethered by strings. The Yaffe reference, while particularly designed for the preparation of balloon clusters tethered by strings, does not permit as rapid an assembly of the decorative bouquets as is desired and requires some visual judgement on the part of the user. The need for the exercise of judgement on the part of the user reduces the utility of the apparatus, for the results will not be uniform from person to person. For example, a short person has a line of visual reference that differs from that of a tall person. If the exercise of judgement is required there is a difference in the bouquets produced by the tall and short persons arising from this difference in visual reference.

SUMMARY OF THE INVENTION

What is required is a balloon sculpturing apparatus which will enable decorative balloon bouquets to be produced rapidly without visual judgement being required on the part of the user.

According to the present invention there is provided a balloon sculpturing apparatus which includes a support and a plurality of inverted receptacles with balloon receiving cavities disposed about the support. Balloons filled with lighter than air gas are retained by buoyancy in the balloon receiving cavities of the inverted receptacles.

The balloon sculpturing apparatus, as described above, a consistency to be achieved from bouquet to bouquet. Equally importantly, this consistency is achieved in a manner that is more time effective than previously known balloon sculpturing apparatus. It is preferred that the relative vertical spacing of the inverted receptacles be adjustable, so as to accommodate alternative configurations of decorative bouquets. The form of support can vary. The support can be ceiling mounted such that the inverted receptacles are suspended are varying heights from the ceiling or the support can be in the form of a vertical stand as reflected in the prior art.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
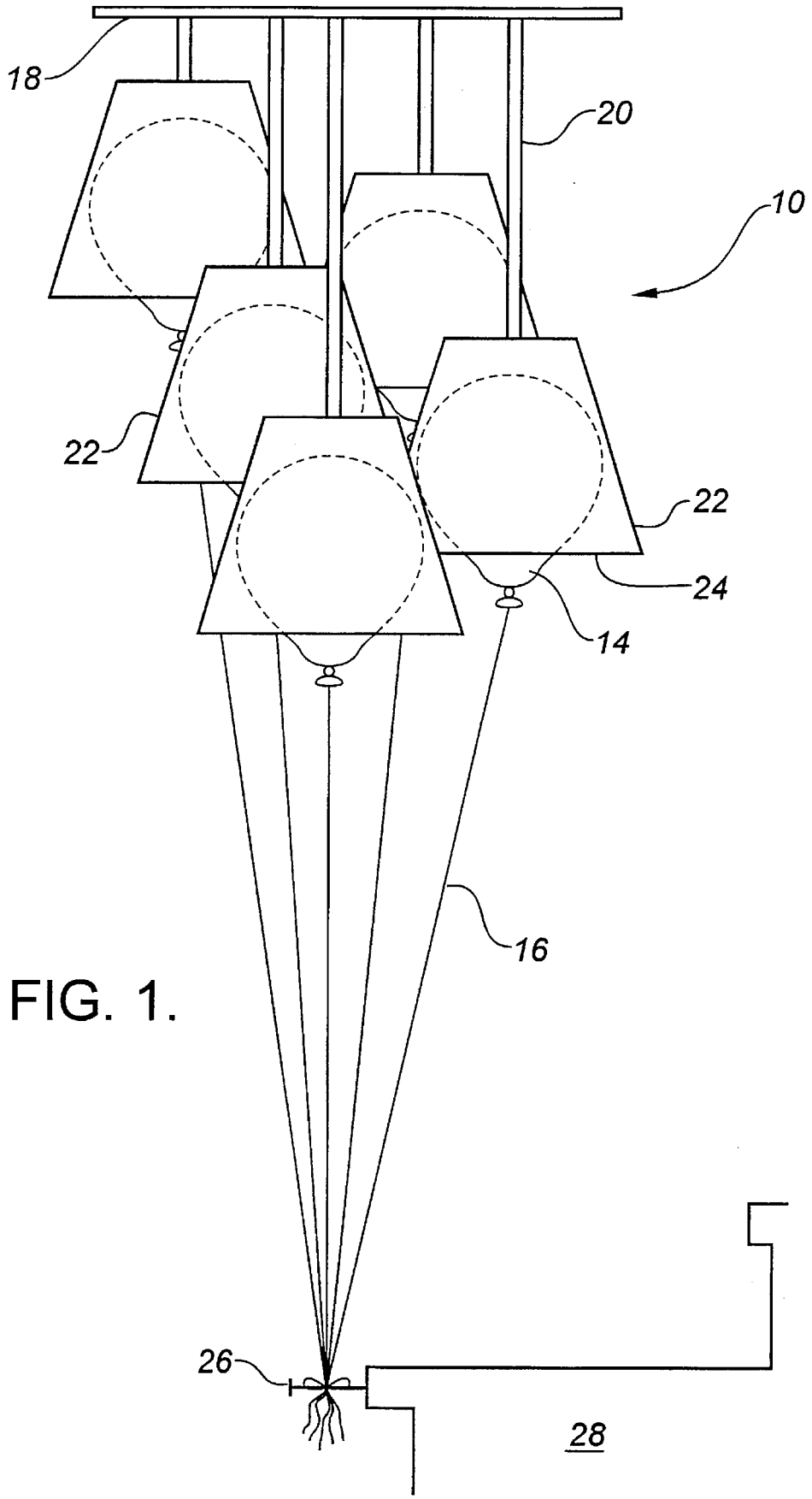
FIG. 1 is a side elevation view of a first embodiment of a balloon sculpturing apparatus constructed in accordance with the teachings of the present invention.
Figure 2:
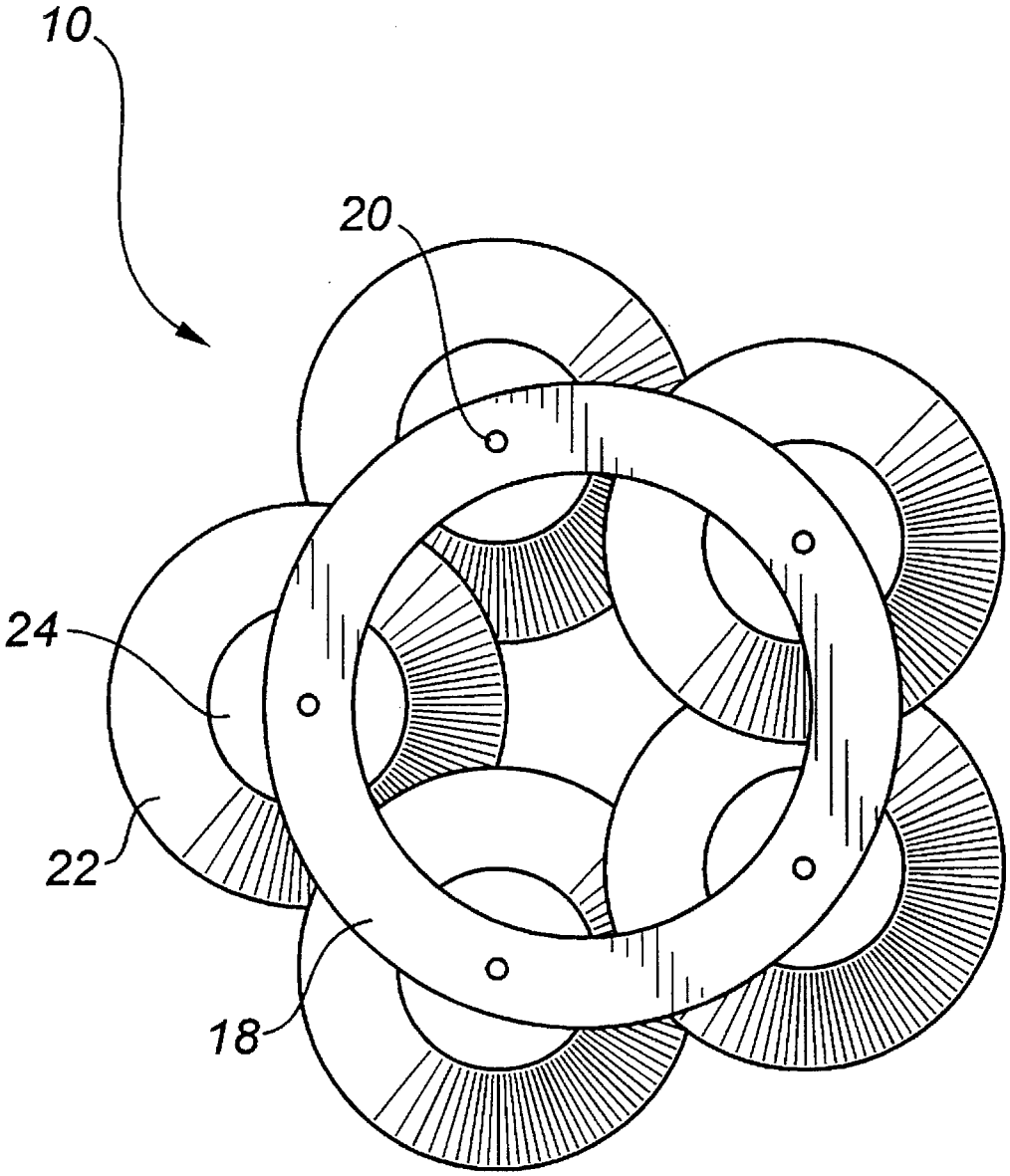
FIG. 2 is a top plan view of the balloon sculpturing apparatus illustrated in FIG. 1.
Figure 3:
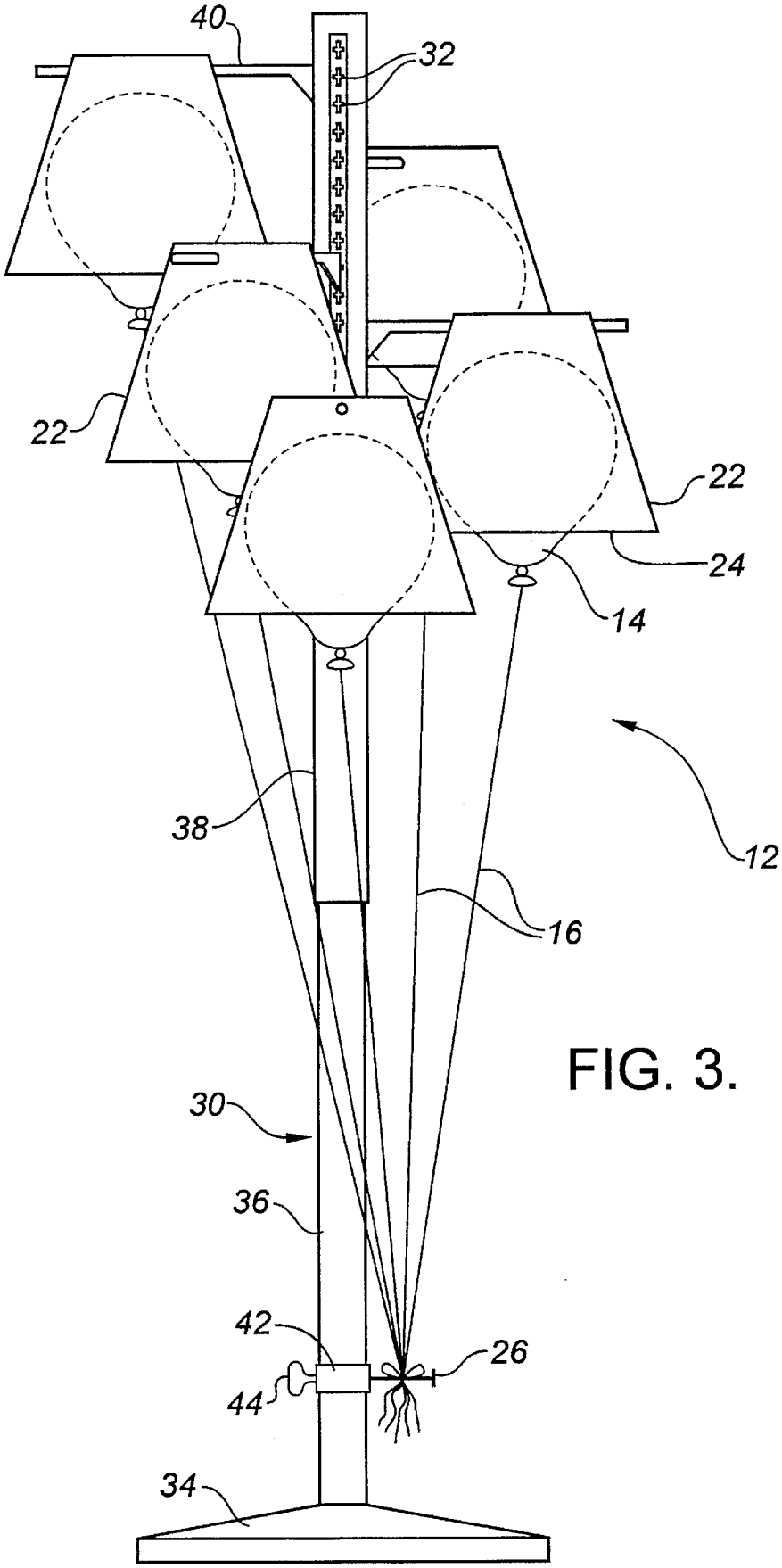
FIG. 3 is a side elevation view of a second embodiment of a balloon sculpturing apparatus constructed in accordance with the teachings of the present invention.
Figure 4:
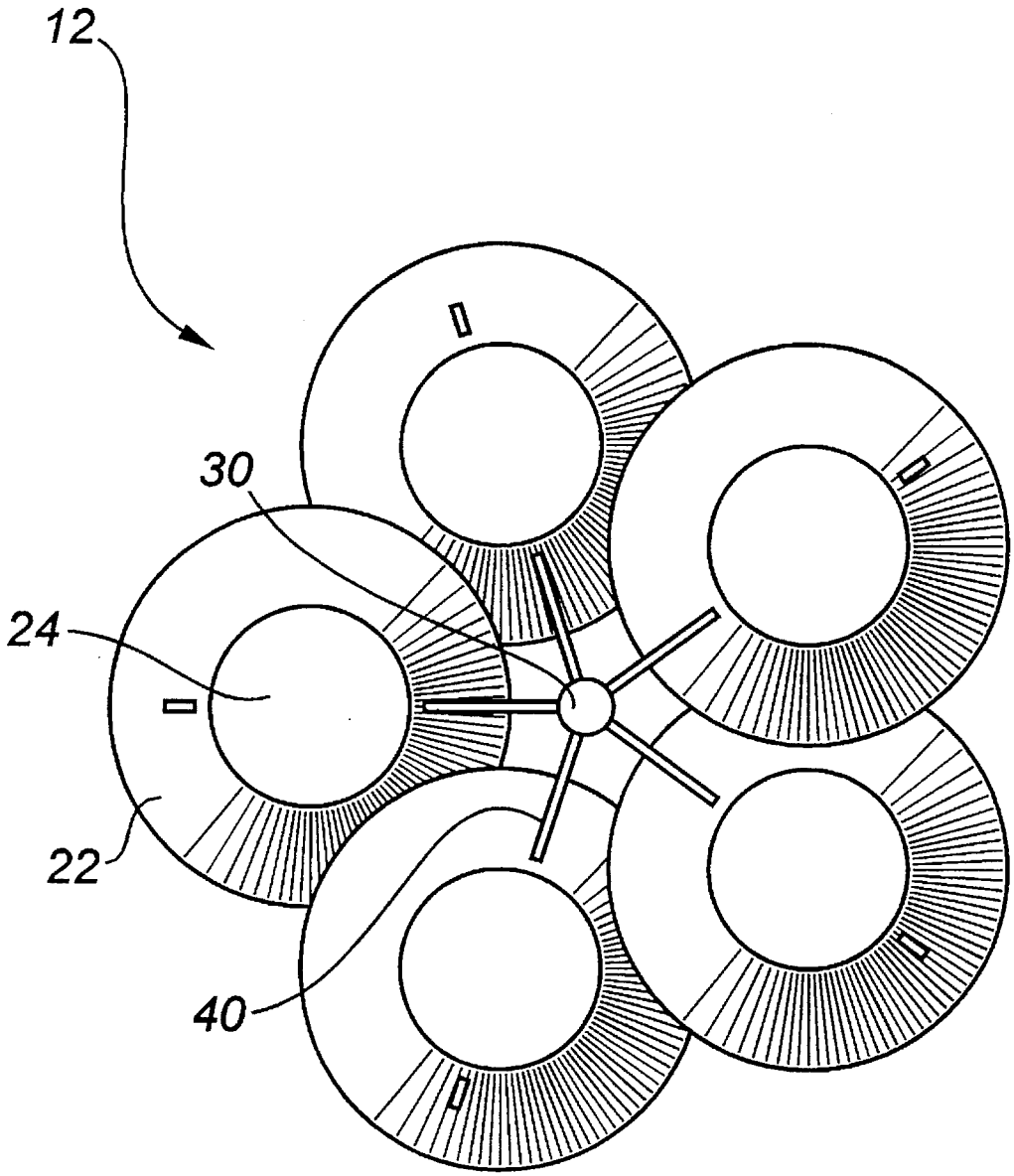
FIG. 4 is a top plan view of the balloon sculpturing apparatus illustrated in FIG. 1.
Figure 5:
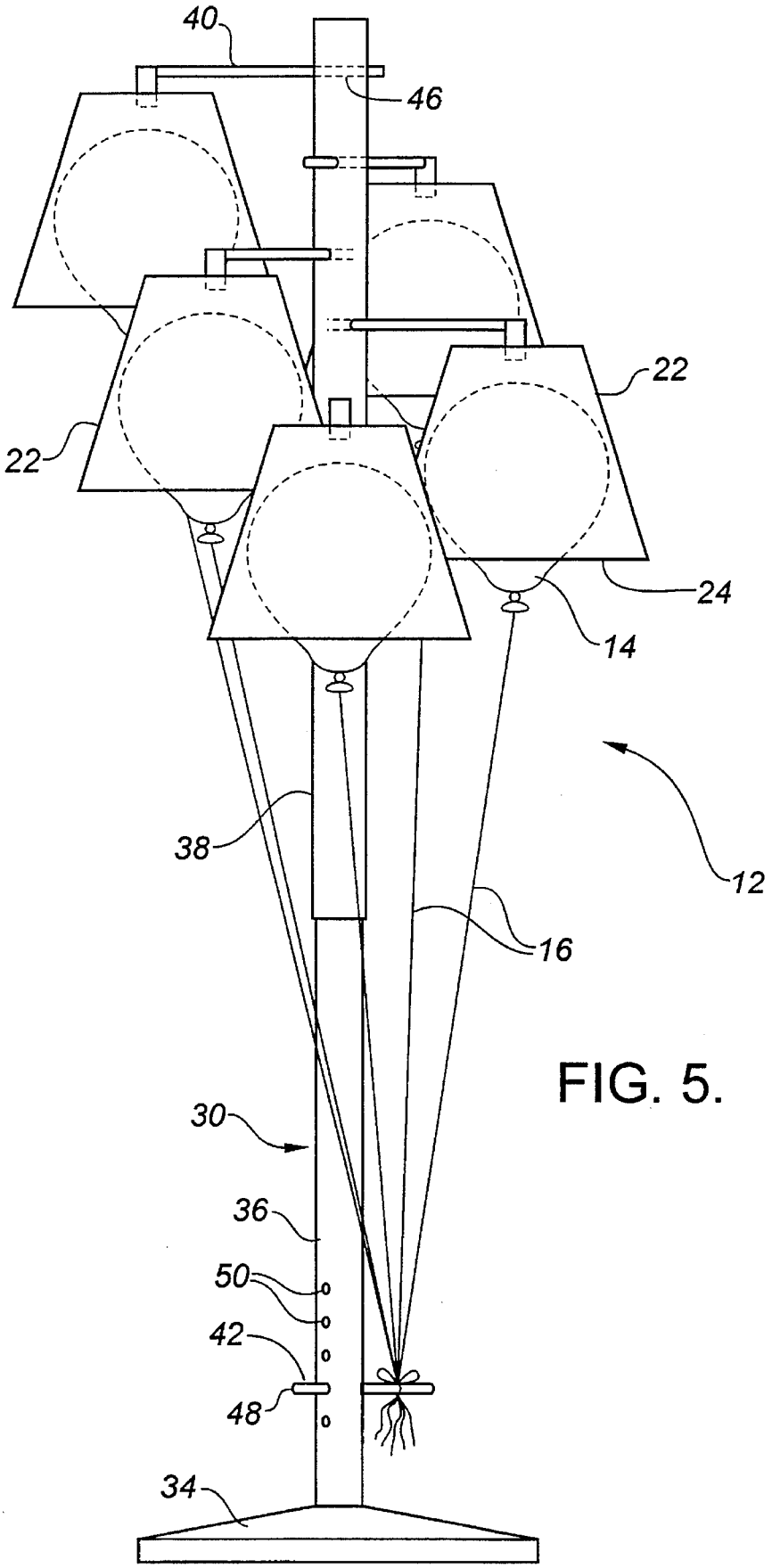
FIG. 5 is a side elevation view of a modified version of the balloon sculpturing apparatus illustrated in FIG. 3.

A balloon sculpturing apparatus will now be described with reference to FIGS. 1 through 5. In order to illustrate the full scope of the invention two alternative embodiments are illustrated. A first embodiment, generally identified by reference numeral 10, is illustrated in FIGS. 1 and 2. A second embodiment, generally identified by reference numeral 12, is illustrated in FIGS. 3 and 4. In the description which follows reference will be made to balloons 14 and strings 16. A modified version of the second embodiment is illustrated in FIG. 5.

Referring to FIGS. 1 and 2, first embodiment 10 of balloon sculpturing apparatus includes a support in the form of a ceiling fixture 18 with a plurality of depending lines 20. A plurality of inverted receptacles 22 with generally conical balloon receiving cavities 24 are secured to depending lines 20.

The use and operation of first embodiment 10 will now be described with reference to FIGS. 1 and 2. First embodiment 10 is intended to be used as a permanent installation in a facility of a balloon decorating business. Ceiling fixture 18 is mounted to a ceiling. Depending lines 20 are arranged at varying heights and then inverted receptacles 22 are attached. In the illustrated embodiment five receptacles have been used, it will be appreciated that every balloon bouquet consists of three or more balloons. Preferably, the five receptacles would be coded in some manner to assist in arranging consistent bouquets in which each receptacle received a particular colour of balloon. The coding can be accomplished through the use of colours, numbers or by relative vertical positioning. For example, if colour coding were used, a red balloon could be placed in a red receptacle, a yellow balloon in a yellow receptacle, etc. Balloons 14 are filled with a lighter than air gas, such as helium. Balloons 14 when filled with helium have a tendency to rise toward the ceiling and are readily retained by buoyancy in balloon receiving cavities 24 of inverted receptacles 22. Balloon receiving cavities 24 are generally conical; this enables varying sizes of balloons to be received. Buoyancy maintains balloons 14 in place while strings 16 are attached. Strings 16 should be cut with respect to a common reference point and then tied together. In FIG. 1, the reference point illustrated is a spike 26 attached to a desk 28. It will be appreciated that any reference point will do. The purpose is to have strings 16 maintain balloons 14 at their relative heights once balloons 14 have been withdrawn from balloon receiving cavities 24. First embodiment 10 is relatively fool proof to use. For example, as long as a red balloon is always placed into the correct inverted receptacle 22 designated for red balloons and the reference point for use in cutting the length of string does not change from bouquet to bouquet, the resulting balloon bouquets will all be identical.

Referring to FIGS. 3 and 4, second embodiment 12 of balloon sculpturing apparatus is intended to be portable for use at a remote site, such as a banquet hall or similar facility. Second embodiment 12 includes a support in the form of a post 30 having a plurality of radially disposed female receptacles 32. To promote portability post 30 has a base 34 and two mating sections 36 and 38. A plurality of branch members 40 are provided. Each of branch members 40 have male members (not shown) which are mating received in female receptacles 32. As with first embodiment 10, a plurality of inverted receptacles 22 with generally conical balloon receiving cavities 24 are provided. Inverted receptacles 22 are secured to branch members 40. Attached to post 30 is a telescopically movable annular string retainer 42. String retainer 42 has a projecting spike 26 to which strings 16 may be tied and has a screw clamp 44 to maintain string retainer 42 in a preselected telescopic position on post 30.

The use and operation of second embodiment 12 of balloon sculpturing apparatus will now be described with reference to FIGS. 3 and 4. The above described components of second embodiment 12 can be carried in a carrying bag (not shown) to a remote site which is to be decorated. Once at the site, sections 36 and 38 are mated to form post 30 and inserted into base 34. Branch members 40 are then radially disposed at varying heights about post 30 by inserting male members (not shown) of branch members 40 into selected female receptacles 32. Inverted receptacles 22 are then secured to branch members 40. As described in relation to FIGS. 1 and 2, it is preferred that receptacles 22 be coded for use with a particular colour of balloon. This indicates that a red balloon is to be placed in a receptacle designated for red balloons, a yellow balloon in a receptacle designated for yellow balloons, etc. Balloons 14 are filled with a lighter than air gas, such as helium. Balloons 14 when filled with helium have a tendency to rise and are readily retained by buoyancy in balloon receiving cavities 24 of inverted receptacles 22. Balloon receiving cavities 24 are generally conical; this enables varying sizes of balloons to be received. Buoyancy maintains balloons 14 in place while strings 16 are attached. Strings 16 should be cut with respect to a common reference point and then tied together. In FIG. 3, the reference point is projecting spike 26 of string retainer 42. As previously described, as long as strings 16 are cut with reference to a common reference point the relative relationship between balloons 14 in the bouquet will be maintained. Spike 26 which serves as the reference point for cutting of strings 16 can be adjusted to any desired height. This is accomplished by loosening screw clamp 44 to enable string retainer 42 to be moved vertically to a desired telescopic position on post 30. The most common heights involving anchoring the at floor level or at table level. Strings 16 are generally tied to spike 26 as the assembly of the bouquet progresses. Once the bouquet is fully assembly, strings 16 may simply be slid off spike 26 and attached to a weight which serves as an anchor. (not shown).

Referring to FIG. 5, there is illustrated a modified version of second embodiment 12. The modification involves a refinement to the manner in which branch members 40 are attached to post 30. The attachment of branch members 40 is simplified by a modified form of female receptacle 32, consisting of a plurality of holes. Holes 46 extend completely through post 30. Branch members 40 are simply slid into selected ones of the plurality of holes 46. Branch members 40 fit snugly into holes 46. Preferably holes 46 are of similar shape to the cross-sectional shape of branch members 40. It has been found that this is a stronger and more durable connection, which is also faster to put together and take apart. Holes 46 are preferably spaced vertically along pole 30 and are placed horizontally at varying angles relative to an imaginary center axis in pole 30. If desired, pins or rings can be extended through branch members 40 to prevent them from being withdrawn from holes 46. FIG. 5 illustrates a similar refinement for string retainer 42. As illustrated in FIG. 5, string retainer 42 is in the form of a rod 48 that can be extended through a selected one of a plurality of holes 50 in post 30.

Completed balloons bouquets are difficult to transport. They take up a lot of room in the back of a van or similar transport vehicle. The strings twist in the wind as the balloon bouquets are carried into the banquet hall or similar remote site. The ability to use a quickly assembled apparatus to prepare the balloon bouquets at a remote site provides significant advantages.

It will be apparent to one skilled in that art that it is much easier to control balloons 14 by placing them in inverted receptacles 22, rather than attempting to control balloons 14 via strings 16 or by pinching the neck portions of balloons 14. This enables much greater speed to be attained in assembling balloon bouquets. The invention also reduces training time and allows salesmen to provide instructions in the form of a worksheet. The worksheet can indicate the number of balloons to be incorporated into each bouquet and information regarding the desired configuration. By numbering female receptacles 32 and designating into which ones branch members 40 are to be inserted, the relative positioning of receptacles 22 can be indicated. The overall height of the bouquet measured from the highest of receptacles 22 to spike 26 can also be indicated, so that string retainer 42 is placed at the correct height. By coding receptacles 22, the worksheet can indicate which colour of balloon is to be placed in which of the receptacles. The resulting bouquets are of consistent quality, even when several persons are working to prepare a banquet hall, each having his own balloon sculpturing apparatus. It will also be apparent to one skilled in the art that modifications may be made to the illustrated embodiment without departing from the spirit and scope of the invention as defined by the claims. The support structure may vary, only two preferred embodiments of many possible alternatives have been disclosed. Inverted receptacles 22 may vary, the generally conical balloon receiving cavity 24 is preferred but there are alternatives which would be equally serviceable. For example, one could be made as a permanent installation on a wall mounted spar, which resembles the first embodiment and swings outwardly from a stored position adjacent a wall.

The embodiments of the invention in which an exclusive property or privilege is claimed are defined as follows:

1. In combination:

a plurality of balloons filled with lighter than air gas;

a balloon sculpturing apparatus, comprising:

a. a support;

b. a plurality of inverted receptacles with balloon receiving cavities disposed about the support, such that the balloons filled with lighter than air gas are retained by buoyancy in the balloon receiving cavities of the inverted receptacles.

2. The combination as defined in claim 1, wherein the support is a post having a plurality of branch members to which the inverted receptacles are mounted.

3. The combination as defined in claim 2, wherein the post has a plurality of female receptacles, and the branch members have male members which are mating received in the female receptacles.

4. The combination as defined in claim 2, wherein the post includes a base and at least two mating sections.

5. The combination as defined in claim 2, wherein the post has a telescopically movable string retainer.

6. The combination as defined in claim 1, wherein the support is a ceiling fixture with a plurality of depending lines to which the inverted receptacles are mounted.

7. The combination as defined in claim 1, wherein the balloon receiving cavities are generally conical.

8. In combination:

a plurality of balloons filled with lighter than air gas;

a balloon sculpturing apparatus, comprising:

a. a support in the form of a post having a plurality of radially disposed female receptacles, the poet including a base and at least two mating sections;

b. a plurality of branch members having male members which are mating received in the female receptacles;

c. a plurality of inverted receptacles with generally conical balloon receiving cavities secured to the branch members, such that the balloons filled with lighter than air gas are retained by buoyancy in the balloon receiving cavities of the inverted receptacles.

9. The combination as defined in claim 8, wherein the poet has a telescopically movable string retainer.

10. In combination:

a plurality of balloons filled with lighter than air gas;

a balloon sculpturing apparatus, comprising:

a. a support in the form of a ceiling fixture with a plurality of depending lines;

b. a plurality of inverted receptacles with generally conical balloon receiving cavities secured to the depending lines, such that the balloons filled with lighter than air gas are retained by buoyancy in the balloon receiving cavities of the inverted receptacles.

* * * * *